US007629561B2

(12) United States Patent
Sohn et al.

(10) Patent No.: US 7,629,561 B2
(45) Date of Patent: Dec. 8, 2009

(54) ELECTRIC OVEN WITH HOOD HAVING OPENING/CLOSING DEVICE TO OPEN AND CLOSE AN EXHAUST PASSAGE

(75) Inventors: Sang Bum Sohn, Seoul (KR); Jong Sik Kim, Seoul (KR); Sung Bae Song, Anyang-si (KR)

(73) Assignee: LG Electronics Inc., Seoul (KR)

( * ) Notice: Subject to any disclaimer, the term of this patent is extended or adjusted under 35 U.S.C. 154(b) by 56 days.

(21) Appl. No.: 11/964,437

(22) Filed: Dec. 26, 2007

(65) Prior Publication Data

US 2008/0156313 A1 Jul. 3, 2008

(30) Foreign Application Priority Data

Dec. 27, 2006 (KR) ..... 10-2006-0134384

(51) Int. Cl.
*H05B 6/64* (2006.01)
*F24C 15/20* (2006.01)

(52) U.S. Cl. ..... 219/757; 219/391; 219/681; 219/400; 126/299 D; 126/121 A; 126/21 R; 126/299 R

(58) Field of Classification Search ..... 219/757, 219/681, 400; 126/21 A, 21 R, 299 R, 299 D
See application file for complete search history.

(56) References Cited

U.S. PATENT DOCUMENTS

| | | | | |
|---|---|---|---|---|
| 4,608,474 | A * | 8/1986 | Kohka | 219/681 |
| 4,786,774 | A * | 11/1988 | Kaminaka | 219/757 |
| 4,839,486 | A * | 6/1989 | Tanigawa | 219/681 |
| 2004/0000547 | A1 * | 1/2004 | Kim | 219/757 |

* cited by examiner

*Primary Examiner*—Shawntina Fuqua
(74) *Attorney, Agent, or Firm*—KED & Associates, LLP

(57) ABSTRACT

An electric oven with a hood is provided. An opening/closing member selectively opens and closes a hood exhaust passage to physically open or close a hood exhaust port. Thus, contaminated air detrimental to a hood fan can be prevented from being suctioned. Accordingly, a reduction in the suctioning force of the hood fan and contamination thereof can be prevented.

17 Claims, 6 Drawing Sheets

ELECTRIC OVEN WITH HOOD HAVING OPENING/CLOSING DEVICE TO OPEN AND CLOSE AN EXHAUST PASSAGE

CROSS-REFERENCE TO RELATED APPLICATIONS

The present application claims priority under 35 U.S.C. 119 and 35 U.S.C. 365 to Korean Patent Application No. 10-2006-0134384 (Dec. 27, 2006), which is hereby incorporated by reference in its entirety.

BACKGROUND

The present disclosure relates to an electric oven, and more particularly, to an electric oven that also functions as a hood.

In general, an electric oven is a cooking apparatus that uses microwaves or/and a heater to cook food. Recently, electric ovens with hoods attached at the bottom thereof have been manufactured in order to perform the function of a hood in filtering and exhausting air including impurities generated during cooking of food back into an indoor space or to the outside.

Such an electric oven is selectively installed with a hood that suctions and filters air including impurities through its bottom, to either exhaust the air back into the indoor space forward from the electric oven or upward to the outdoor environment. To perform the function of a hood, a hood fan within the hood/electric oven assembly is selectively installed so that its exhausting port faces forward or upward to exhaust air.

However, the following limitations exist with such related art electric ovens with hoods.

First, when the exhaust port of the hood fan is installed facing upward to exhaust the filtered air to the outdoors, contaminated air from the indoor space can also be suctioned through a passage for discharging filtered air back into the indoor space. Thus, the suctioning force of the hood fan is reduced.

Also, as described above, when contaminated air from the indoor space is suctioned through the passage for exhausting filtered air back into the indoor space without being filtered, the contaminated air can contaminate the hood fan.

SUMMARY

Embodiments provide an electric oven with a hood capable of preventing a reduction in suctioning force of the hood fan.

Embodiments also provide an electric oven with a hood capable of preventing contamination of the hood fan.

In one embodiment, an electric oven with a hood fan includes: a cavity provided with a cooking compartment; a hood fan installed on a side of the cavity, to suction external air including contaminants, filter the contaminants from the external air, and exhaust the filtered air to an outside; an exhaust passage through which the filtered air is exhausted to the outside, through operation of the hood fan; and an opening/closing device selectively opening and closing the exhaust passage.

In another embodiment, an electric oven with a hood includes: a cavity provided with a cooking compartment; a hood fan installed on one side of the cavity, to suction indoor air including contaminants, filter the contaminants from the suctioned indoor air, and selectively exhaust the filtered air to an indoor space or outdoors; an indoor exhaust port exhausting the filtered air to the indoor space through an operation of the hood fan; an outdoor exhaust port exhausting the filtered air to the outdoors through the operation of the hood fan; and an opening/closing device selectively opening and closing the indoor exhaust port, wherein the opening/closing device opens the indoor exhaust port only when the filtered air is exhausted to the indoor space.

In a further embodiment, an electric oven with a hood includes: a cavity provided with a cooking compartment; a hood fan installed on one side of the cavity, to suction indoor air including contaminants, filter the contaminants from the suctioned indoor air, and selectively exhaust the filtered air to an indoor space or outdoors; an indoor exhaust port discharging the filtered air to the indoor space through an operation of the hood fan; and an outdoor exhaust port discharging the filtered air to the outdoors through the operation of the hood fan, wherein the indoor exhaust port and the outdoor exhaust port are selectively opened and closed according to the exhausting of the filtered air through the operation of the hood fan.

According to the present disclosure, a reduction in the suctioning force and contamination of the hood fan can be prevented.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

An electric oven with a hood according to a first embodiment of the present disclosure will be described below with reference to the diagrams.

Figure 1:
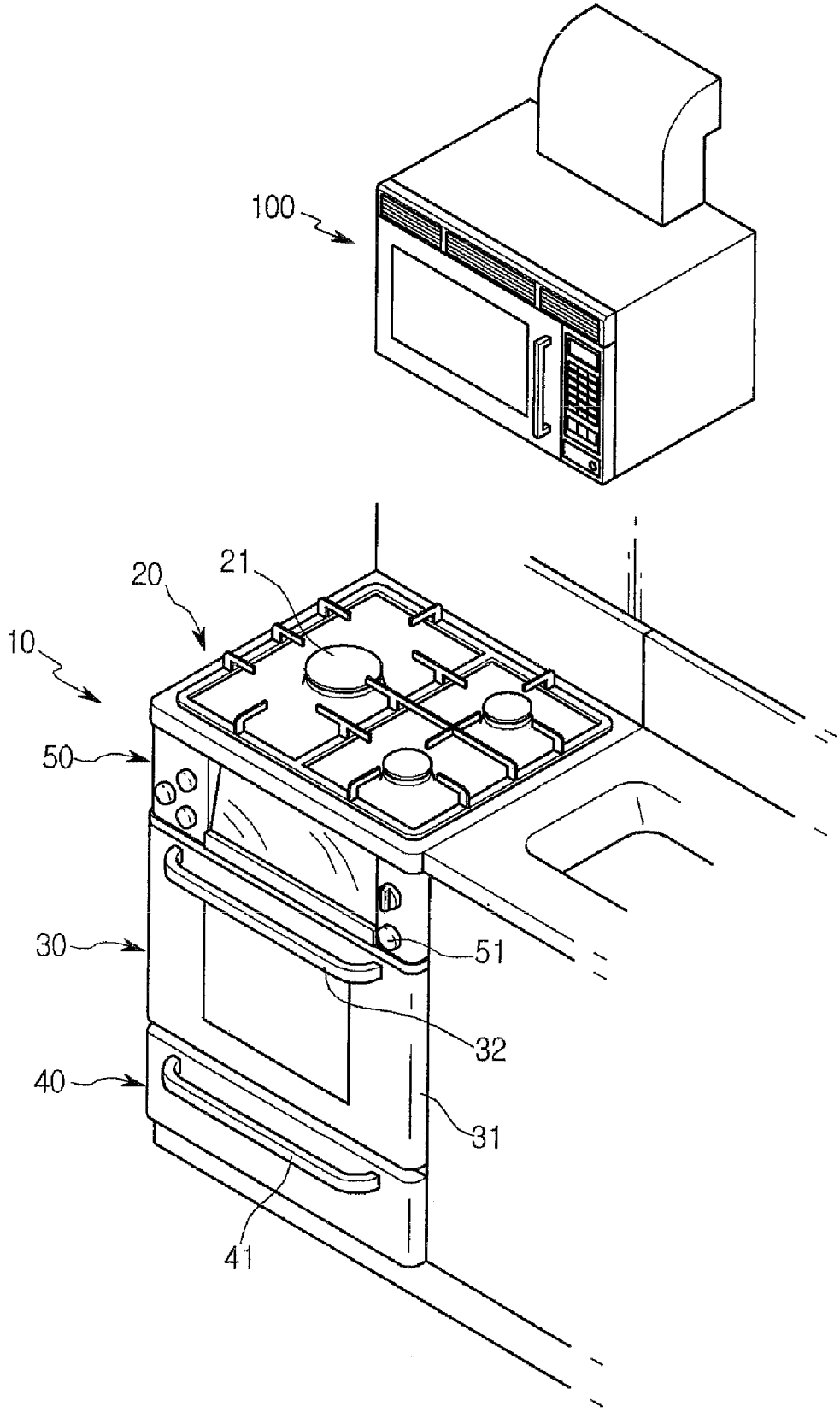
FIG. 1 is a perspective view showing an electric oven with a hood according to a first embodiment of the present disclosure.
Figure 2:
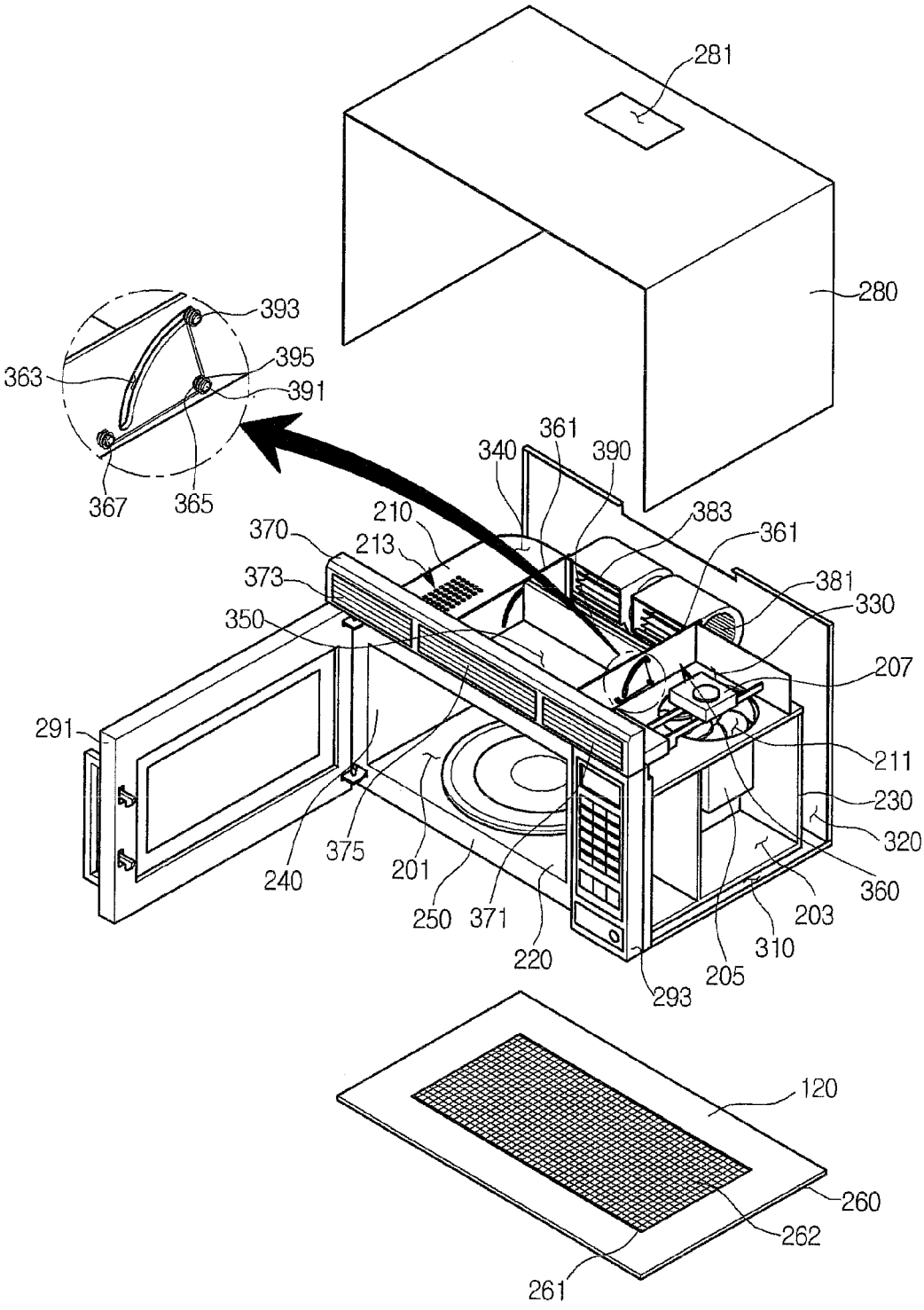
FIG. 2 is an exploded perspective view of the electric oven with the hood according to the first embodiment.

FIG. 1 is a perspective view showing an electric oven with a hood according to a first embodiment of the present disclosure, and FIG. 2 is an exploded perspective view of the electric oven with the hood according to the first embodiment.

Referring to FIGS. 1 and 2, an electric oven with a hood (hereinafter referred to as an 'electric oven') 100 has a gas oven range 10 installed below it. The gas oven range 10 includes a cooktop 20, an oven 30, a warming drawer 40, and a controller 50.

The cooktop 20 and oven 30 are regions that perform cooking of food. The warming drawer 40 is a region for warming vessels containing food, and the controller 50 is a region that receives inputs of various control signals for operating the gas oven range 10.

In detail, the cooktop 20 is disposed at the upper portion of the gas oven range 10. The cooktop 20 includes a plurality of burners 22. The burners combust gas to heat vessels containing food.

The oven 30 is provided below the cooktop 20 at the central portion of the gas oven range 10. A cooking compartment (not shown) is defined within the oven 30 for cooking food by means of a heater (not shown). The cooking compartment is selectively opened and closed by a door 31. The top end of the gas oven range 10 door 31 pivots upward and downward about an axis at a bottom end of the door 31, to selectively open and close the cooking compartment. The front surface of the door 31 has a handle 32 for a user to grasp in opening and closing the door 31.

The warming drawer 40 is provided at the lower portion of the gas range oven 10 below the oven 30. The warming drawer 40 is installed to slide in and out of the gas range oven 10 as a drawer. A vessel containing food is placed inside the warming drawer 40, and the heater for cooking food in the heater or a separate warming heater is used to generate heat to warm the vessel and food. The front of the warming drawer 40 also has a drawer handle 41 provided thereon for a user to grasp in pulling out and pushing in the warming drawer 40.

The controller 50 is provided at the front surface of the cooktop 20. The controller 50 includes a plurality of control knobs 51 for controlling the cooktop 20, the oven 30, and the warming drawer 40.

The electric oven 100, while cooking food with microwaves or/and heaters, also filters air including contaminants including oil particles generated during cooking with the cooktop 20 or the oven 30, and discharges the filtered air back into the indoor space or to the outside.

Referring to FIG. 2, an upper plate 210, a bottom plate 220, a rear plate 230, and two side plates 240 respectively form the upper, bottom, rear, and side surfaces of a cavity 200 of the electric oven 100. A cooking compartment 201 and a machine compartment 203 are provided within the cavity 200. The cooking compartment 201 is a region in which cooking of food is performed, and is physically defined by the upper plate 210, bottom plate 220, rear plate 230, and two side plates 240. The machine compartment 203 includes a plurality of electrical devices such as a magnetron 205 (when the electric oven 100 is a microwave oven) installed therein. The machine compartment 203 is formed to outside of the upper plate 210, bottom plate 220, rear plate 230, and side plates 240 to the right of the right side plate 240 in FIG. 2.

A cooling fan 207 is installed in the machine compartment 203. The cooling fan 207 may be physically installed in a cooling fan installing hole 211 defined in the upper plate 210. The cooling fan 207 functions to cool electrical components including the magnetron 205 by suctioning indoor air through a cooling suctioning port 371 (described below) and directing the airflow downward.

The side plate 240 between the cooling compartment 201 and machine compartment 203 and the upper plate 210 respectively includes a suctioning port (not shown) and an exhaust port 213 defined therein. The suctioning port functions as an entrance through which air that cools the electrical components including the magnetron 205 is suctioned into the cooking compartment. The exhaust port 213 functions as an exit through which air including impurities generated during cooking of food in the cooking compartment 201 is discharged.

The cavity 200 is defined by a front plate 250, a base plate 260, a back plate 270, and an outer case 280 that are coupled together. The front plate 250 is coupled at the front of the cavity 200 to form its front surface. The base plate 260 is coupled at the bottom of the cavity 200 to form its bottom surface. The base plate 260 defines a hood suctioning port 261 for suctioning contaminated air. Also, the hood suctioning port 261 is provided with a filter 262 for filtering impurities from the contaminated air. The back plate 270 is coupled at the rear of the cavity 200. The outer case 280 is coupled at the top and either side of the cavity 200. The back plate 270 forms the rear outer surface, and the outer case 280 forms the upper and side outer surfaces of the cavity 200. In addition, a hood outdoor exhaust port 281 is defined at one side of the outer case 280. The hood outdoor exhaust port 281 functions as an exit for exhausting air to the outside after it is filtered.

A door 291 selectively opens and closes the cooking chamber 201. The door 291 is installed on the cavity so that one side can pivot about an axis on the other side.

A control panel 293 is provided at one side of the front plate 250 to the front of the machine compartment 203. The control panel 293 receives manipulation-induced control signals for operating the electric oven, and displays information on the operation of the electric oven 100 to the outside.

A passage is formed in the lower portion, the rear portion, and upper portion of the cavity 200. Specifically, the lower portion of the cavity 200, that is, a first hood suctioning passage 310, is provided between the bottom plate 220 and the base plate 260. A second hood passage 320 is provided at the rear portion of the cavity 200 between the rear plate 230 and the back plate 270. The first and second hood passages 310 and 320 are portions through which contaminated air, suctioned through the hood suctioning port 261 by means of a hood fan 380 (described below), flows. The rear portion of the first hood suctioning passage 310 and the lower portion of the second hood suctioning passage 320 communicate with one another. Also, the upper portion of the cavity 200, that is, a cooling suctioning passage 330 between the upper plate 210 and outer case 280, includes a cooling exhaust passage 340 and a hood exhaust passage 350. The cooling suctioning passage 330 and the cooling discharging passage 340 are regions through which air that is suctioned for cooling the electrical components including the magnetron 205 by means of the cooling fan's 207 operation and through which the suctioned air is discharged after it cools the components. Also, contaminated air, suctioned by the operation of the hood fan 380 into the hood suctioning port 261 and through the first and second suctioning passages 310 and 320, is discharged through the hood exhaust passage 350 back into the indoor space.

According to the first embodiment, the cooling suctioning passage 330 and the cooling exhaust passage 340 are respectively provided at the upper right and left sides of the cavity 200, and the hood exhaust passage 350 is defined on the upper surface at the central portion of the cavity 200 between the cooling fuctioning passage 330 and the cooling exhaust passage 340.

An air duct 360 is provided on the top surface of the upper plate 210 to partition the cooling suctioning passage 330, the cooling exhaust passage 340, and the hood exhaust passage 350 provided atop the cavity 200. In more detail, two air guides 361 are included in the air duct 360. The air guides 361 are elongated from front to rear at the top surface of the upper plate 210 a predetermined distance to the left and right of one another. The right air guide 361 in the FIGS. 2 and 6 divides the cooling Suctioning passage 330 and the hood exhaust passage 350. The left air guide 361 in FIGS. 2 and 6 divides the cooling exhaust passage 340 and the hood exhaust passage 350.

A vent grill 370 is provided at the upper portion of the front plate 250. The vent grill 370 functions as an intake/exhaust port for cooling air and an exhaust port for filtered air. For this end, the vent grill 370 includes a cooling Auctioning port 370, a cooling exhaust port 373, and a hood indoor exhaust port 375. The cooling suctioning port 371, cooling exhaust port 373, and hood indoor exhaust port 375 are provided at the right end portion, left end portion, and central portion corresponding to the indoor suctioning passage 330, indoor exhaust passage 340, and hood exhaust passage 350, respectively, in FIGS. 2 and 6.

A hood fan 380 is provided on the top surface of the cavity 200 corresponding to the rear portion of the hood exhaust passage 350—that is, on the top surface of the upper plate 210. The hood fan 380 includes one fan motor and two fans provided at either side of the fan motor. The hood fan 380 is installed on the top surface of the upper plate 210 elongated laterally. Also, the hood fan 380 has a suctioning port 381 at the end of either side thereof. Accordingly, the suctioning ports 381 of the suctioning fan 380 are physically communicated with the second suctioning passage 320. Also, an exhaust port 383 of the hood fan 380 is provided on a surface of the hood fan 380 intersecting the suctioning port 381. The exhaust port 383 of the hood fan 380 is directed upward or frontward according to whether the filtered air is discharged to the outdoors or the indoor space. In other words, when the filtered air is discharged outdoors through the hood outdoor exhaust port 281, the hood fan 380 has its exhaust port 383 directed upwards. When the filtered air passes through the hood exhaust passage 350 and back into the indoor space through the hood indoor exhaust port 375, the hood fan 380 has its exhaust port 383 disposed in a forward direction. Specifically, the exhaust port 383 of the hood fan 380 is selectively communicated with the hood outdoor exhaust port 281 or the hood indoor exhaust passage 350.

A passage opening/closing device is installed in the hood exhaust passage 350 toward the front of the hood fan 380. The opening/closing device functions to selectively open and close the hood exhaust passage 350 according to the exhausted direction of the filtered air discharged by the hood fan 380.

In further detail, when the filtered air is discharged to the outdoors through the hood outdoor exhaust port 281 by the hood fan 380, that is, when the exhaust port 383 of the hood fan 380 is installed so that the hood fan 380 is directed upward to communicate with the hood outdoor exhaust port 281, the opening/closing device closes the hood exhaust passage 350. When the filtered air is blown by the hood fan 380 through the hood exhaust passage 350 so that the air is discharged to the indoor space through the hood indoor exhaust port 375, the opening/closing device opens the hood exhaust passage 350. Here, the hood fan 380 is installed so that the exhaust port 383 of the hood fan 380 faces frontward.

To perform the above function, the opening/closing device includes an opening/closing member 390 that physically opens/closes the hood exhaust passage 350, a guide slot 363 that guides the pivoting of the opening/closing member 390 for opening/closing the hood exhaust passage 350, and a tensile member 395 imparting biasing force to the opening/closing member 390 toward its closed position in the hood exhaust passage 350.

The opening/closing member 390 is configured as a plate disposed in a cross-sectional direction of the hood exhaust passage 350 in a direction perpendicular to the airflow of the filtered air. The opening/closing member 390 is installed at the rear portion of the hood exhaust passage 350 proximal to the hood fan 380 and capable of pivoting within a predetermined angular range. Specifically, the top end of the opening/closing member 390 pivots about its bottom end in a pull-down movement. Here, the opening/closing member 390 pivots from a perpendicular disposition on the floor of the hood exhaust passage 350, (or the top surface of the upper plate 210) to approximately a parallel disposition to the upper plate 210—that is, within a range of 90°. That is, when the opening/closing member 390 is disposed perpendicularly on the top surface of the upper plate 210, the opening/closing member 390 closes the hood exhaust passage. When the opening/closing member 390 is pivoted to an acute angle with respect to the top surface of the upper plate 210, the hood exhaust passage 350 is partially opened. When the opening/closing member 390 is pivoted until it is parallel to the top surface of the upper plate 210, the hood exhaust passage 350 is entirely opened. Here, the opening/closing member 390 pivots by means of the filtered air blown through the hood exhaust passage 350 by the operation of the hood fan 380, to open the hood exhaust passage 350.

Two hinge protrusions 391 and guide protrusions 393 are provided on the opening/closing member 390. The hinge protrusions 391 extend outward from either bottom side of the opening/closing member 390, respectively. The hinge protrusions 391 are inserted into hinge holes 365 (described below) to function as a pivoting axis of the opening/closing member 390. The guide protrusions 393 extend outward from either top side of the opening/closing member 390, respectively. The guide protrusions 393 insert into the guide slots 363 to guide the pivoting of the opening/closing member 390 and restrict the pivoting range of the opening/closing member 390.

The guide slots 363 are formed at corresponding locations in the air guides 361. The guide slots 363 are formed circularly over an approximate angular range of 90°.

A hinge hole 365 is formed at one side of the guides 361, respectively, at the radial centers of the guide slots 363. The hinge protrusions 391 are inserted into the hinge holes 365, respectively.

Supporting protrusions 367 are provided at sides of the air guides 361, respectively, at the front of the guide slots 363. The supporting protrusions 367 extend in mutually diverging directions at the surfaces of the air guides 361.

In the first embodiment of the present disclosure, a torsion spring is used as the tensile member 395. The tensile member 395 is installed on the leading end portion of the hinge protrusions inserted in the hinge hole 365. The ends of the tensile member 395 are respectively supported on the guide protrusion 393 and supporting protrusion 367. The tensile member 395 imparts biasing force on the opening/closing member 390 in the direction in which the opening/closing member 390 closes the hood exhaust passage 350—that is, the direction in which the opening/closing member 390 pivots toward a perpendicular to the upper plate 210. The strength of the biasing force of the tensile member 395 may be determined according to the output of the hood fan, so as to lie in a range that allows the opening/closing member 390 to be pivoted by means of filtered air blown through the hood exhaust passage 350 by the hood fan 380. In other words, the biasing force of the tensile member 395 may be set at a value less than the external force imparted on the opening/closing member 390 by the filtered air blown by the hood fan 380 through the hood exhaust passage 350.

Below, a more detailed description of an electric oven with a hood according to the first embodiment of the present disclosure will be provided with reference to the diagrams.

Figure 3:
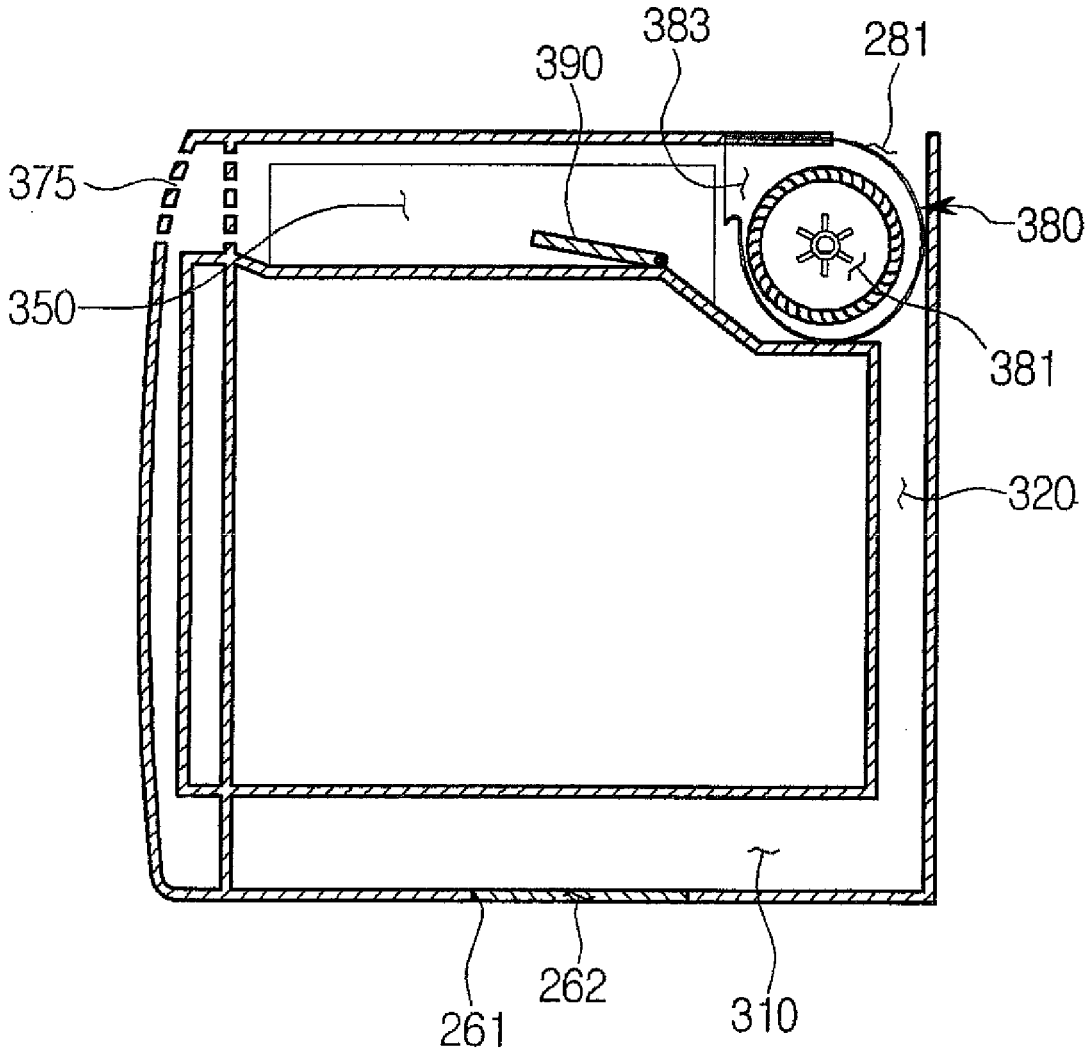
FIGS. 3 and 4 are cross-sectional views showing the electric oven with the hood according to the first embodiment discharging filtered air back into an indoor space.
Figure 4:
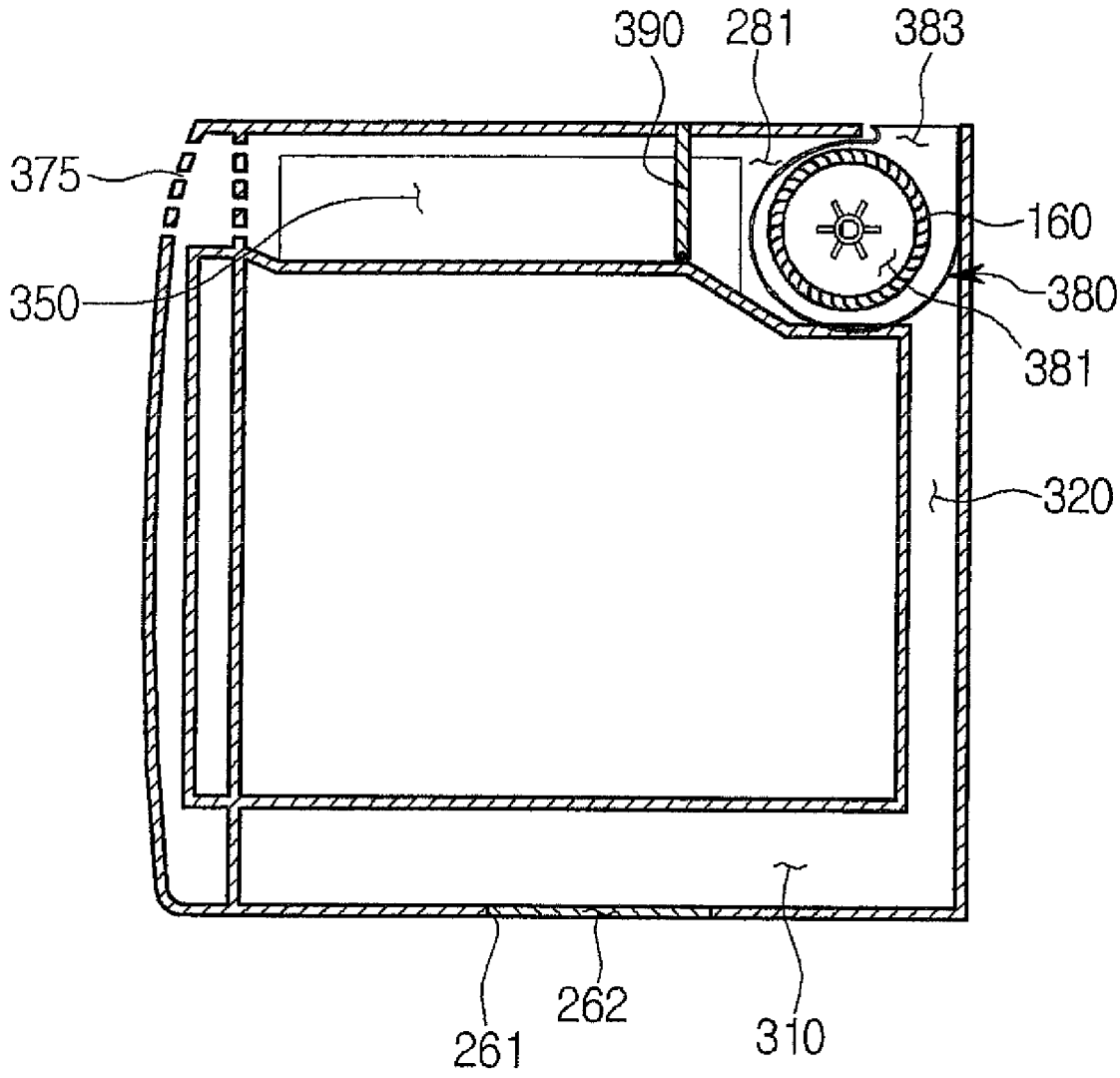
Figure 5:
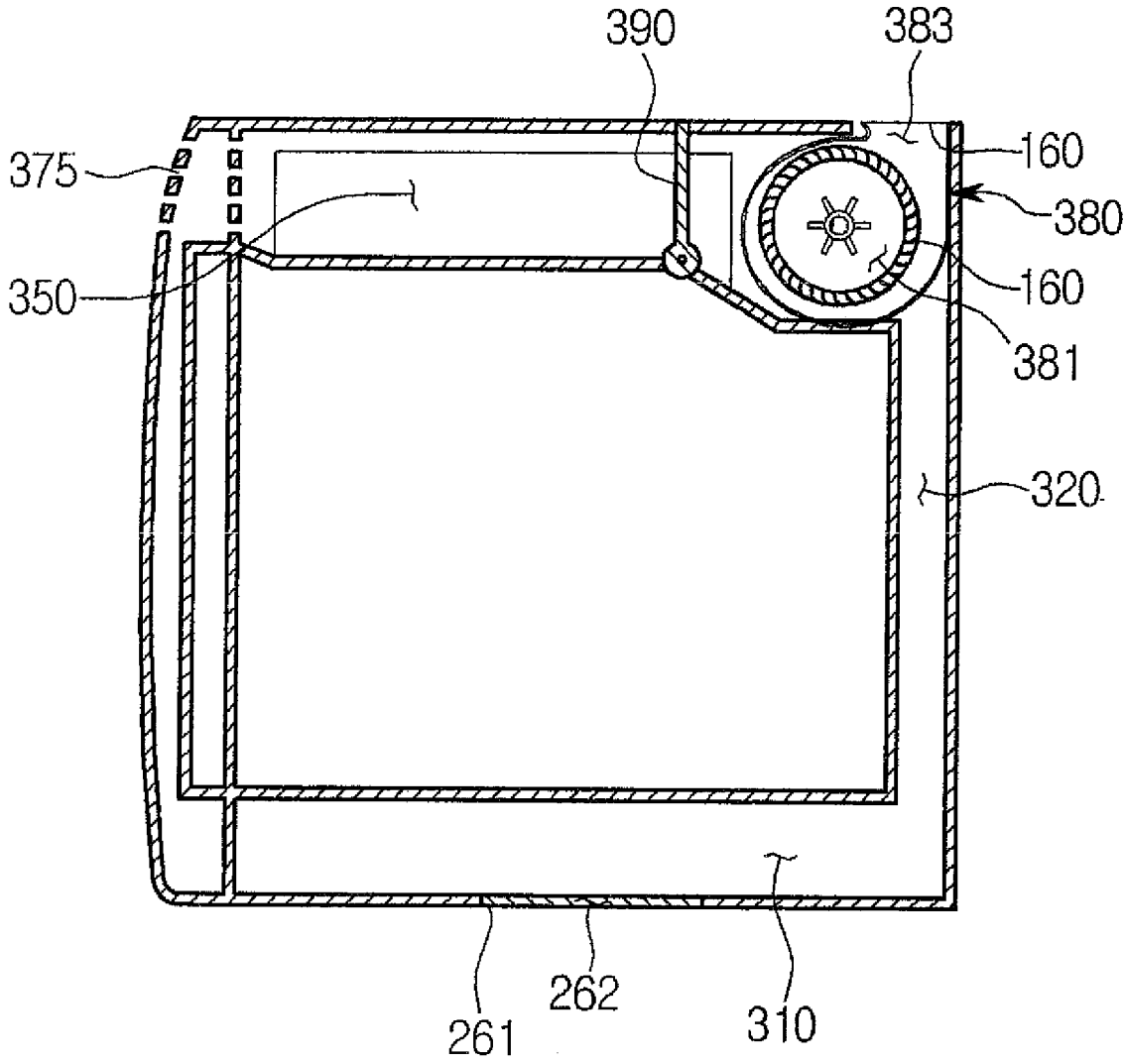
FIG. 5 is a cross-sectional view showing the electric oven with the hood according to the first embodiment discharging filtered air to the outdoors.

FIGS. 3 and 4 are cross-sectional views showing the electric oven with the hood according to the first embodiment discharging filtered air back into an indoor space, and FIG. 5 is a cross-sectional view showing the electric oven with the hood according to the first embodiment discharging filtered air to the outdoors.

First, referring to FIGS. 3 and 4, air that includes impurities generated during cooking of food with the gas oven range 10 (in FIG. 1) is filtered and discharged back into an indoor space, and exhausted to the left in FIGS. 3 and 4 (or forward from the electric oven 100), due to the exhaust port 383 of the hood fan 380 being communicated with the hood exhaust passage 350. Here, the hood exhaust passage 350 is sealed by means of the opening/closing member 390, and the hood indoor exhaust port 281 is physically closed by the hood fan 380.

Accordingly, when the hood fan 380 is driven, air including impurities generated during cooking by the gas oven range 10 passes through the hood suctioning port 261 into the first hood suctioning passage 310. Here, the impurities included in the contaminated air suctioned through the hood suctioning port 261 are filtered by the filter 262.

Through continuous driving of the hood fan 380, the filtered air flows through the first hood suctioning passage 310 and the second hood suctioning passage 320, and is suctioned into the suctioning port 381 of the hood fan 380. The filtered air suctioned into the suctioning port 381 of the hood fan 380 flows through the exhaust port 383 of the hood fan 380 and is discharged through the hood exhaust passage 350.

The filtered air that passes through the exhaust port 383 of the hood fan 380 and is discharged through the hood exhaust passage 350 pushes the opening/closing member 390 to the left (in FIGS. 3 and 4). Accordingly, the opening/closing member 390 overcomes the biasing force of the tensile member 395, and rotates in a counterclockwise direction in FIGS. 3 and 4 about the hinge protrusions 391 to open the hood exhaust passage 350. When the hood exhaust passage 350 is thus opened, the filtered air flows through the hood exhaust passage 350 and is discharged back into the indoor space through the hood indoor exhaust port 375.

Next, referring to FIG. 5, to discharge air including impurities generated during cooking of food by the gas oven range 10 to the outdoors, the exhaust port 383 of the hood fan 380 is directed upward in the electric oven 100 to communicate with the hood outdoor exhaust port 281. Here also, the hood exhaust port 350 is sealed by the opening/closing member 390.

In this state, when the hood fan 380 is driven, the air including impurities is filtered of the impurities by the filter 262 while flowing through the hood suctioning port 261 and being suctioned through the hood suctioning port 261 into the first hood suctioning passage 310. Also, the air removed of impurities by the filter 262 flows through the first and second suctioning passage 310 and 320 and is suctioned into the suctioning port 381 of the hood fan 380. The filtered air suctioned through the suctioning port 381 of the hood fan 380 passes through the exhaust port 383 of the hood fan 380 and the hood outdoor exhaust port 281 to the outdoors.

However, as described above, the tensile member 395 biases the opening/closing member 390 to physically maintain the hood exhaust passage 350 in a closed state. Thus, the flowing of indoor air through the hood indoor exhaust port 375 or the flowing of air containing contaminants generated during cooking of food by the gas oven range 10 flowing through the hood exhaust passage 350 and being suctioned through the suctioning port 381 of the hood fan 380 can be prevented.

Below, an electric oven with a hood according to a second embodiment of the present disclosure will be described in detail, with reference to the drawings.

Figure 6:
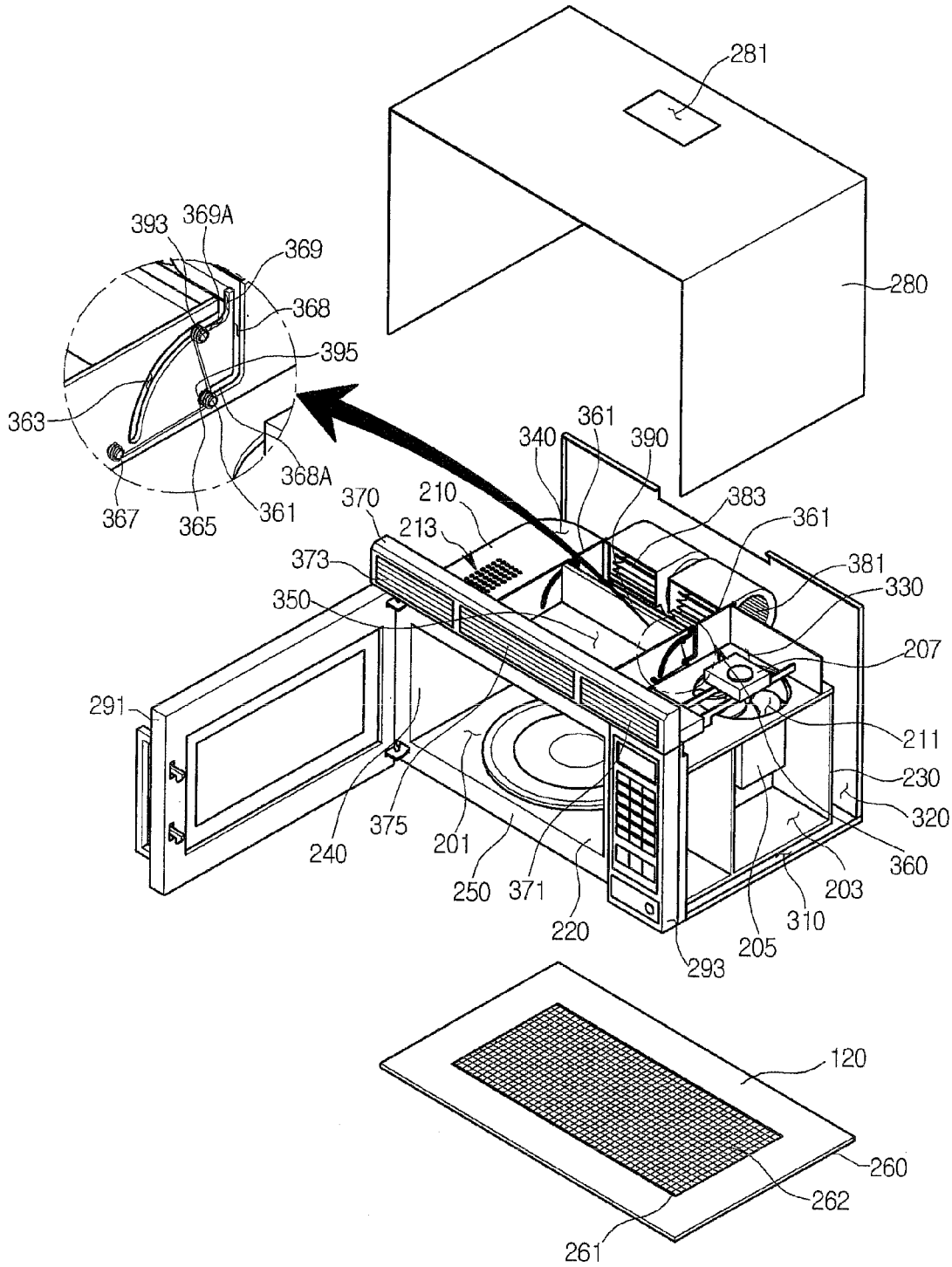
FIG. 6 is a cross-sectional view showing an electric oven with a hood according to a second embodiment of the present disclosure.

FIG. 6 is a cross-sectional view showing an electric oven with a hood according to a second embodiment of the present disclosure. Like elements as those in the first embodiment of the present disclosure will be deemed already described in the above descriptions referring to FIG. 2.

Referring to FIG. 6, according to the second embodiment of the present disclosure, the opening/closing member 390 is detachably installed. For this end, a first detachable slot 368 communicating with the hinge hole 365, and a second detachable slot 369 communicating with the guide slot 363 are respectively provided on the air guides 361.

The first detachable slot 368 extends from the upper end of the air guide 361 downward in order to communicate its lower end with the hinge hole 365. Accordingly, the hinge protrusion 391 can move along the first detachable slot 368 to be disposed at the hinge hole 365.

The second detachable slot 369 extends from the upper end of the air guide 361 downward, to communicate with the guide slot 363. Accordingly, the guide protrusion 393 can move along the second detachable slot 369 to be disposed at the guide slot 363.

Also, the first and second detachable slots 368 and 369 are respectively provided with engaging regions 368A and 368B. The engaging regions 368A and 368B prevent disengagement of the hinge protrusion 391 from the hinge hole 365 and the guide protrusion 393 from the guide slot 363. In the present embodiment, the engaging regions 368A and 368B are respectively formed through curving a portion of the first detachable slot 368 proximate to the hinge hole 365 and a portion of the second detachable slot 369 proximate to the guide slot 363.

The electric oven with a hood according to the above description of the present disclosure may have the following effects.

First, according to the present disclosure, through the position of the hood fan, that is, through the discharged direction of airflow by the hood fan, the indoor exhaust passage can selectively be opened and closed by means of the opening/closing member. Thus, contaminated indoor air passing through the indoor exhaust passage into the hood fan can be prevented, so that the hood fan can be operated without its suctioning force compromised.

Also, according to the present disclosure, as described above, the entry of contaminated air through the indoor exhaust passage into the hood fan can be prevented. Accordingly, contamination of the hood fan by contaminated air entering through the indoor exhaust passage can be prevented.

Any reference in this specification to one embodiment, an embodiment, exemplary embodiment, etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with others of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An electric oven with a hood, the electric oven comprising:

a cavity provided with a cooking compartment;

a hood fan installed on a side of the cavity, to suction external air including contaminants from outside of the electric oven, to filter the contaminants from the external air, and to exhaust the filtered air to an outside;

an exhaust passage through which the filtered air is exhausted to the outside, through operation of the hood fan; and an opening/closing device to selectively open and close the exhaust passage, wherein the opening/closing device is operated by the filtered air exhausted through the exhaust passage through the operation of the hood fan, to selectively open and close the exhaust passage.

2. The electric oven with the hood according to claim 1, wherein the filtered air exhausted through the exhaust passage is discharged to an indoor space.

3. The electric oven with the hood according to claim 1, wherein the opening/closing device includes an opening/closing member pivotably installed in the exhaust passage to selectively open and close the exhaust passage.

4. The electric oven with the hood according to claim 3, wherein the opening/closing member is detachably installed in the exhaust passage.

5. The electric oven with the hood according to claim 3, wherein the opening/closing member further includes a hinge protrusion provided at one end on either side of the opening/closing member to function as a rotational axis thereof, the hinge protrusions moving within detachable slots respectively defined in each of two air guides that define the exhaust passage.

6. The electric oven with the hood according to claim 5, wherein the air guides respectively further define a hinge hole communicating with the detachable slots, respectively, and into which the hinge protrusions are respectively inserted.

7. The electric oven with the hood according to claim 6, wherein the detachable slots respectively include an engaging region to prevent disengaging of the hinge protrusions when the hinge protrusions are inserted in the hinge holes.

8. The electric oven with the hood according to claim 1, wherein the opening/closing device comprises:

an opening/closing member pivotably installed in the exhaust passage, to selectively open and close the exhaust passage according to an airflow through the exhaust passage through the operation of the hood fan; and a tensile member imparting a biasing force on the opening/closing member to pivot the opening/closing member in a direction closing the exhaust passage.

9. The electric oven with the hood according to claim 8, wherein the biasing force of the tensile member is set at a comparatively smaller value than an external force imparted on the opening/closing member by the airflow through the exhaust passage through the operation of the hood fan.

10. An electric oven with a hood, comprising:

a cavity provided with a cooking compartment;

a hood fan installed on one side of the cavity, to suction indoor air including contaminants from outside of the electric oven, to filter the contaminants from the suctioned indoor air, and to selectively exhaust the filtered air to an indoor space or outdoors;

an indoor exhaust port exhausting the filtered air to the indoor space through an operation of the hood fan;

an outdoor exhaust port exhausting the filtered air to the outdoors through the operation of the hood fan; and an opening/closing device to selectively open and close the indoor exhaust port, wherein the opening/closing device opens the indoor exhaust port only when the filtered air is exhausted to the indoor space, wherein the opening/closing device opens the indoor exhaust port through an airflow of the filtered air toward the indoor exhaust port through the operation of the hood fan.

11. The electric oven with the hood according to claim 10, wherein the opening/closing device includes an opening/closing member opening the indoor exhaust port through the airflow of the filtered air toward the indoor exhaust port.

12. The electric oven with the hood according to claim 10, wherein the opening/closing device comprises:

an opening/closing member that opens the indoor exhaust port through the airflow of the filtered air toward the indoor exhaust port based on the operation of the hood fan; and a tensile member imparting a biasing force on the opening/closing member to pivot in a direction closing the indoor exhaust passage.

13. The electric oven with the hood according to claim 12, wherein the biasing force of the tensile member is set at a comparatively smaller value than an external force imparted on the opening/closing member by the airflow toward the indoor exhaust port through the operation of the hood fan.

14. The electric oven with the hood according to claim 10, wherein the indoor exhaust port is provided to one side of a vent grill installed at a front surface of the cavity, and the outdoor exhaust port is provided in a side of an outer case sealing at least an upper surface of the cavity.

15. An electric oven with a hood, comprising:

a cavity provided with a cooking compartment;

a hood fan installed on one side of the cavity, to suction indoor air including contaminants from outside of the electric oven, to filter the contaminants from the suctioned indoor air, and to selectively exhaust the filtered air to an indoor space or outdoors;

an indoor exhaust port discharging the filtered air to the indoor space based on an operation of the hood fan; and an outdoor exhaust port discharging the filtered air to the outdoors based on the operation of the hood fan, wherein an opening/closing device is opened through an airflow of the filtered air toward the indoor exhaust port.

16. The electric oven with the hood according to claim 15, wherein the opening/closing device comprises:

an opening/closing member selectively opening and closing the indoor exhaust port through the airflow of the filtered air toward the indoor exhaust port through the operation of the hood fan; and a tensile member imparting a biasing force on the opening/closing member to pivot in a direction closing the indoor exhaust passage.

17. The electric oven with the hood according to claim 15, wherein the outdoor exhaust port is closed by a fan housing defining an exterior of the hood fan, when the filtered air is exhausted to the indoor space through the operation of the hood fan.

* * * * *